US005903240A

United States Patent [19]

Kawahata et al.

[11] Patent Number: 5,903,240

[45] **Date of Patent: *May 11, 1999**

[54] SURFACE MOUNTING ANTENNA AND COMMUNICATION APPARATUS USING THE SAME ANTENNA

[75] Inventors: Kazunari Kawahata, Kyoto; Kazuhisa Yamaki, Muko, both of Japan

[73] Assignee: Murata Mfg. Co. Ltd, Kyoto, Japan

[ * ] Notice: This patent is subject to a terminal disclaimer.

[21] Appl. No.: 08/799,694

[22] Filed: Feb. 11, 1997

[30] Foreign Application Priority Data

Feb. 13, 1996 [JP] Japan ..... 8-025548

[51] Int. Cl.[6] ..... H01Q 1/38; H01Q 1/24

[52] U.S. Cl. ..... 343/700 MS; 343/702; 343/846

[58] Field of Search ..... 343/700 MS, 702, 343/873, 846, 872, 848, 849, 895

[56] References Cited

U.S. PATENT DOCUMENTS

| | | | |
|---|---|---|---|
| 4,138,681 | 2/1979 | Davidson et al. | 343/702 |
| 4,309,707 | 1/1982 | James et al. | 343/895 |
| 4,780,598 | 10/1988 | Fahey et al. | 219/511 |
| 4,839,659 | 6/1989 | Stern et al. | 343/700 MS |
| 5,308,468 | 5/1994 | Katoh et al. | 204/419 |
| 5,402,134 | 3/1995 | Miller et al. | 343/742 |
| 5,541,616 | 7/1996 | Kawahata et al. | 343/702 |
| 5,585,807 | 12/1996 | Takei | 343/702 |
| 5,696,517 | 12/1997 | Kawahata et al. | 343/700 MS |
| 5,748,149 | 5/1998 | Kawahata | 343/700 MS |

FOREIGN PATENT DOCUMENTS

| | | |
|---|---|---|
| 55898/73 | 11/1974 | Australia . |
| 332139 | 9/1989 | European Pat. Off. . |
| 746054 | 5/1996 | European Pat. Off. . |
| 743699 | 11/1996 | European Pat. Off. . |
| 91 01577 | 2/1991 | WIPO . |

*Primary Examiner*—Michael J. Tokar
*Assistant Examiner*—Qui Van Duong
*Attorney, Agent, or Firm*—Ostrolenk, Faber, Gerb & Soffen, LLP

[57] ABSTRACT

A surface mounting antenna in which a wider frequency bandwidth can be achieved and a dual-frequency signal can be obtained without hampering the gain and needing to enlarge the configuration of the antenna. Also disclosed is a communication apparatus using this type of antenna. Two radiation electrodes for producing different resonant frequencies and a feeding electrode are formed on the obverse surface of a substrate formed of a dielectric material or a magnetic material. A ground electrode is primarily disposed on the reverse surface of the substrate. The radiation electrodes form open ends and are connected at the other ends to the ground electrode. The open ends of the radiation electrodes and the feeding electrode are electromagnetically coupled to each other through capacitances generated in gaps formed between the feeding electrode and the open ends.

35 Claims, 5 Drawing Sheets

(FIG. 1)
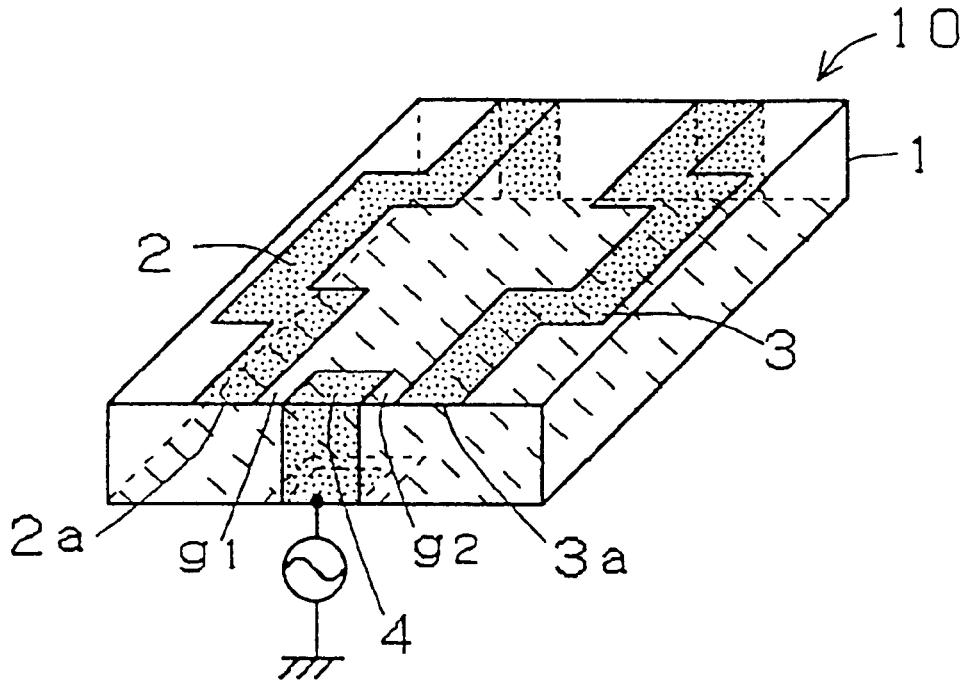
(FIG. 2)
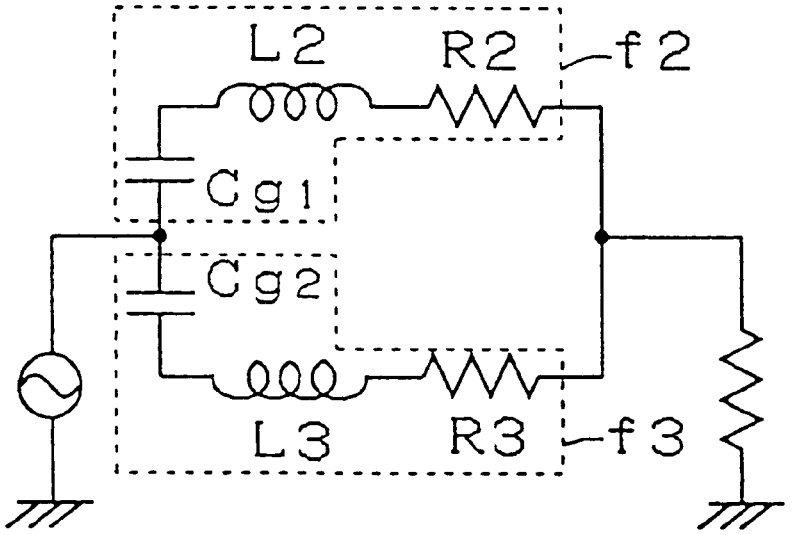

(FIG. 3)
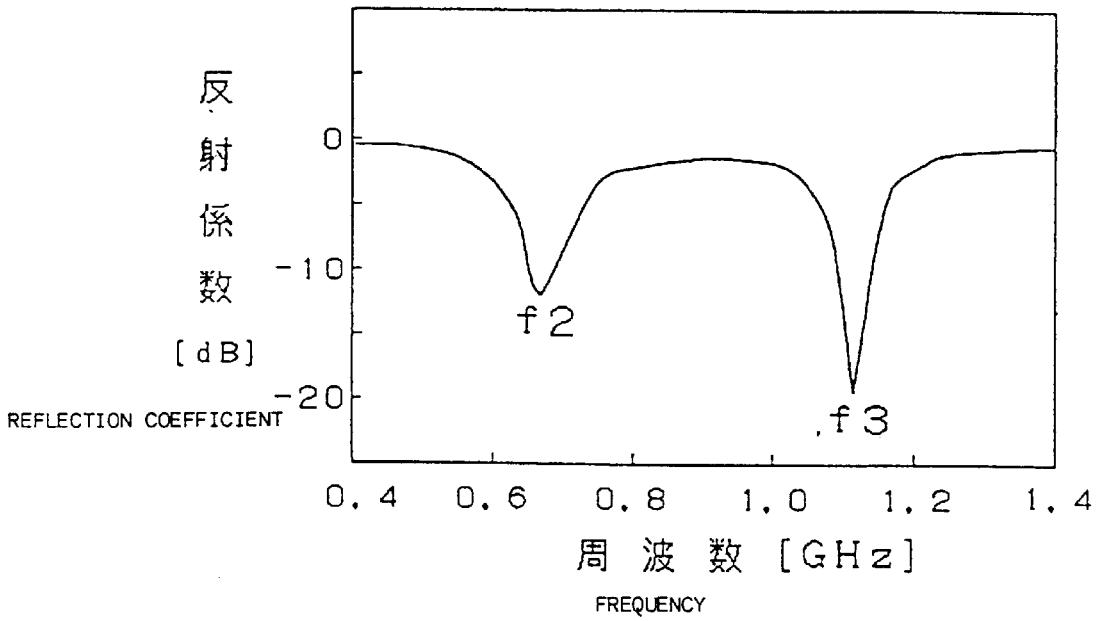
(FIG. 4)
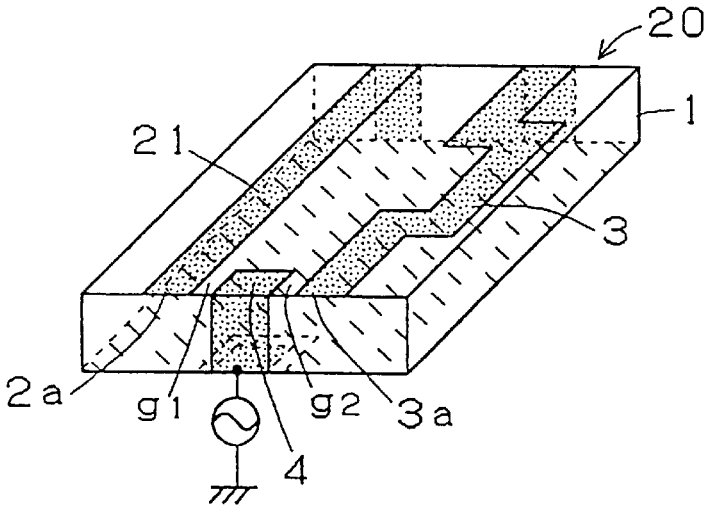

(FIG. 5)
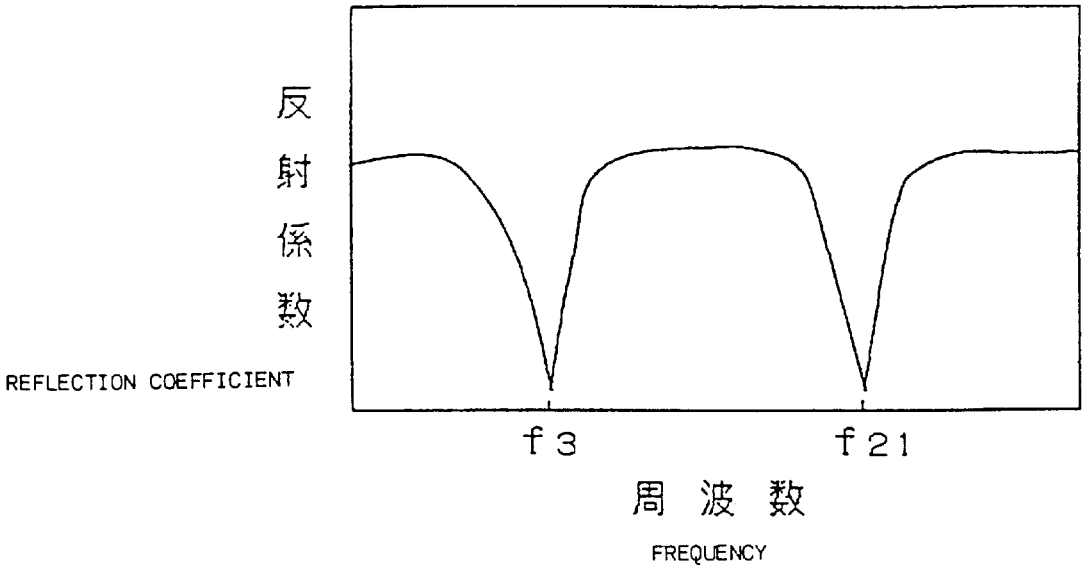
(FIG. 6)
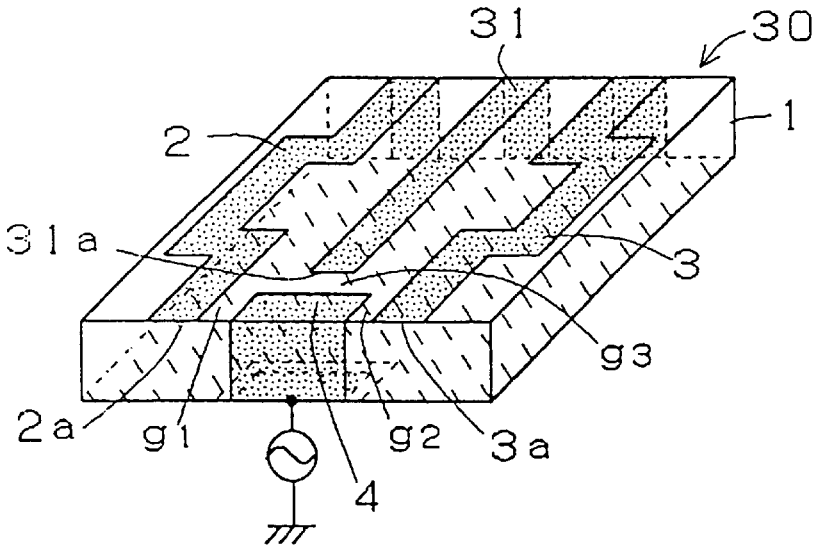

(FIG. 7)
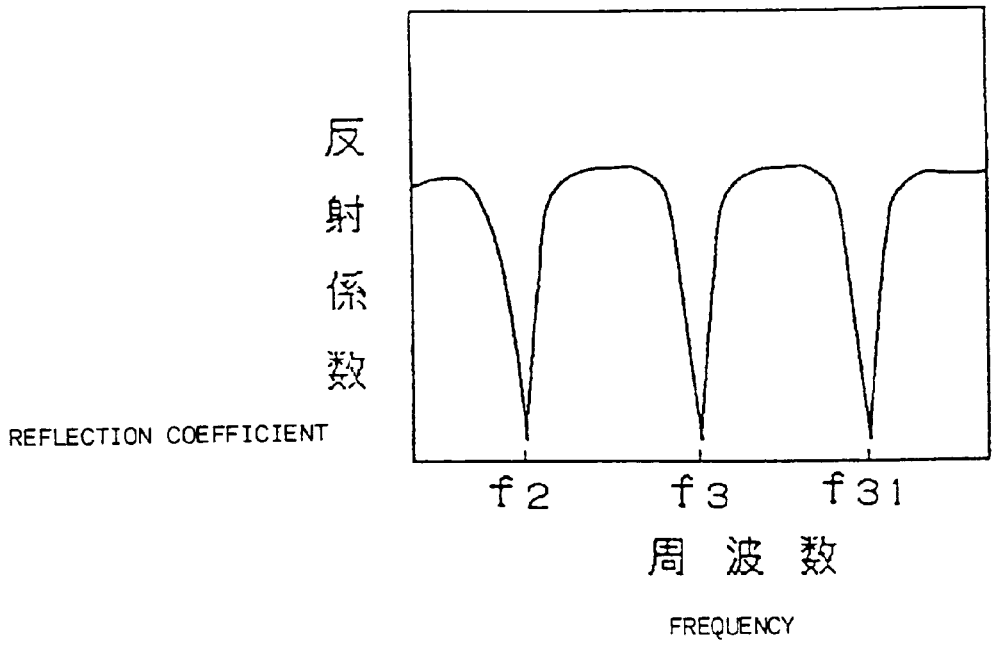
(FIG. 8)
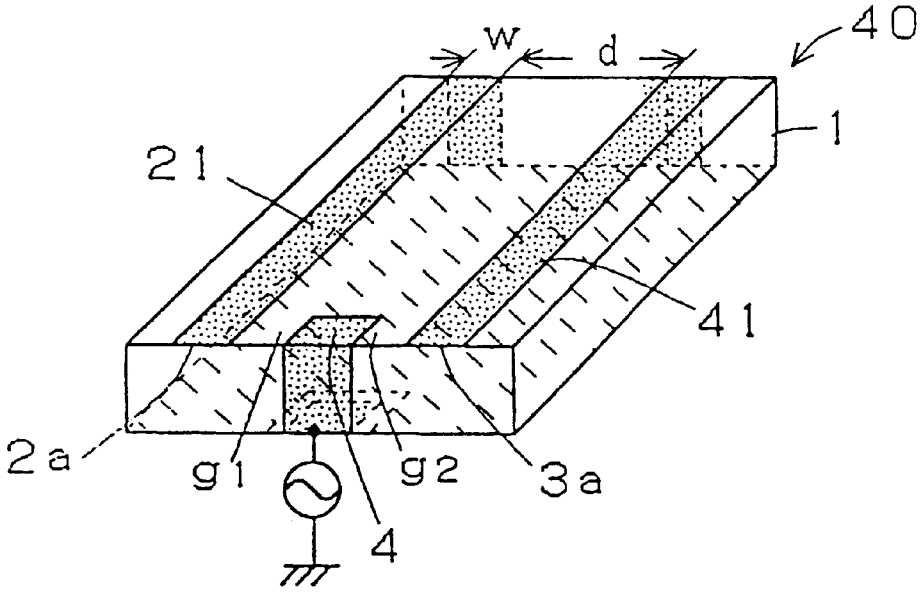

(FIG. 9)
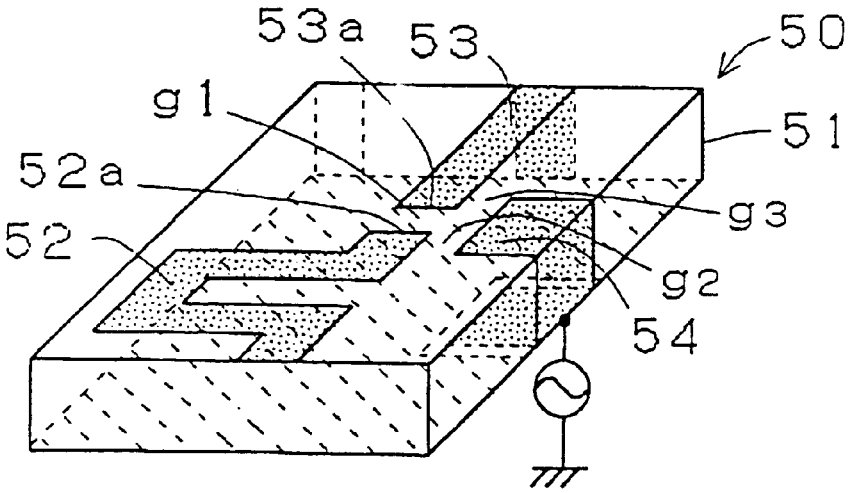
(FIG. 10)
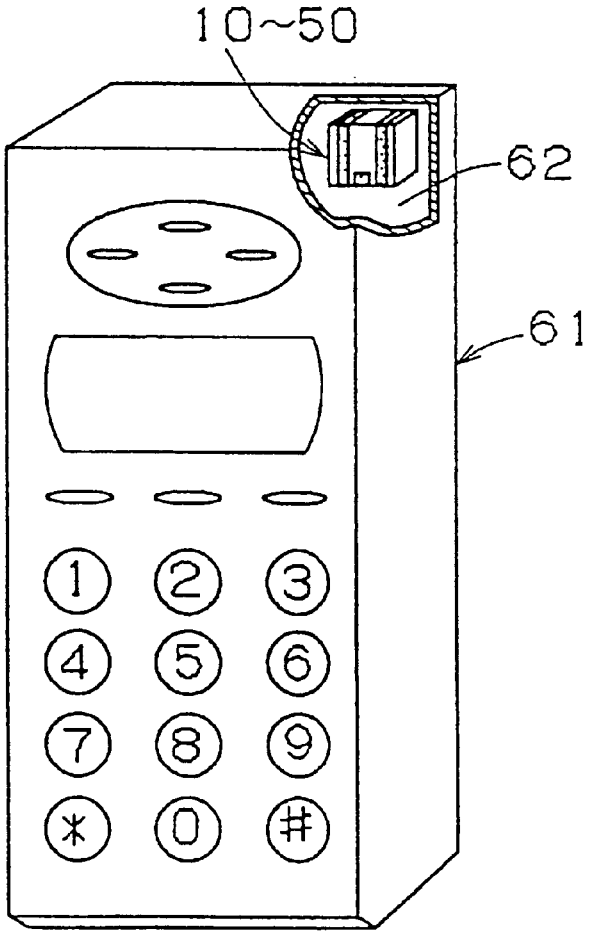

SURFACE MOUNTING ANTENNA AND COMMUNICATION APPARATUS USING THE SAME ANTENNA

BACKGROUND OF THE INVENTION

1. Field of the Invention

The present invention relates to surface mounting antennas used in mobile communication apparatus, such as mobile cellular telephones, or in radio Local Area Networks (LAN). The invention also relates to communication apparatus using the above type of antenna.

2. Description of the Related Art

In known types of surface mounting antennas, the radiation resistance is increased or the radiation electrodes are made larger in order to achieve wider bandwidth. Also, in conventional types of surface mounting antenna units, two antennas are required to obtain a signal corresponding to two frequencies.

However, stripline radiation electrodes are widened with a view to implementing a wider bandwidth with the result that downsizing of the overall antenna of the above conventional type is hampered. Further, the provision of two antennas for obtaining two frequencies requires a large area, thus enlarging the resulting antenna unit and accordingly increasing the size of a communication apparatus provided with this type of antenna unit.

SUMMARY OF THE INVENTION

Accordingly, it is an object of the present invention to provide a surface mounting antenna in which a wider frequency bandwidth and a signal having a plurality of frequencies can be obtained without needing to enlarge the configuration of the overall antenna and also to provide a communication apparatus using this type of antenna.

In order to achieve the above object, according to one form of the present invention, there is provided a surface mounting antenna comprising: a substrate formed of at least one of a dielectric material and a magnetic material; at least two radiation electrodes for producing different resonant frequencies, disposed on a first main surface of the substrate; a feeding electrode disposed on the first main surface of the substrate; and a ground electrode disposed on a second main surface of the substrate, wherein the radiation electrodes are each open at one end and connected at the other end to the ground electrode, and the feeding electrode and the open ends of the radiation electrodes are electromagnetically coupled to each other via capacitances.

In the above type of antenna, the distance between the two radiation electrodes may be equal to three times or larger than the width of the electrodes. Also, opposite-directional currents may be caused to flow in the radiation electrodes.

According to another form of the present invention, there is provided a communication apparatus having the above type of surface mounting antenna.

In this manner, at least two radiation electrodes for producing different resonant frequencies are disposed on a single substrate. With the use of this single substrate, an antenna can be constructed through which signals having a plurality of frequencies can be transmitted and received, like an antenna sharing apparatus. Also, a plurality of frequencies can be brought close to each other, so that a wider-band antenna, like a stagger tuning circuit, can be obtained.

Moreover, the distance between the plurality of radiation electrodes is determined as equal to three times or larger than the electrode width, which can suppress coupling between the radiation electrodes, thereby reducing loss. Additionally, opposite-directional currents are caused to flow in the plurality of radiation electrodes, thereby inhibiting electromagnetic coupling between the radiation electrodes.

Further, a communication apparatus having the above type of antenna can offer advantages similar to those achieved by the antenna. Thus, a wider-band, higher-gain and downsized communication apparatus can be attained.

BRIEF DESCRIPTION OF THE DRAWINGS

FIG. 1 is a perspective view of a surface mounting antenna according to a first embodiment of the present invention;

FIG. 2 is a diagram illustrating an electrical equivalent circuit of the surface mounting antenna shown in FIG. 1;

FIG. 3 illustrates the frequency characteristics of the surface mounting antenna shown in FIG. 1;

FIG. 4 is a perspective view of a surface mounting antenna according to a second embodiment of the present invention;

FIG. 5 illustrates the frequency characteristics of the surface mounting antenna shown in FIG. 4;

FIG. 6 is a perspective view of a surface mounting antenna according to a third embodiment of the present invention;

FIG. 7 illustrates the frequency characteristics of the surface mounting antenna shown in FIG. 6;

FIG. 8 is a perspective view of a surface mounting antenna according to a fourth embodiment of the present invention;

FIG. 9 is a perspective view of a surface mounting antenna according to a fifth embodiment of the present invention; and FIG. 10 is a perspective view of a communication apparatus provided with one of the surface mounting antennas of the present invention.

DETAILED DESCRIPTION OF EMBODIMENTS OF THE INVENTION

Embodiments of the present invention will now be described with reference to the drawings. Referring to a perspective view illustrating a first embodiment of the present invention shown in FIG. 1, a surface mounting antenna generally designated by 10 includes a rectangular substrate 1 formed of a dielectric material, such as ceramic or resin, or a magnetic material, such as ferrite. Radiation electrodes 2 and 3 having a length of approximately $\lambda/4$ of a predetermined frequency are disposed in parallel to each other at a regular interval on the substantially peripheral portions of the obverse surface of the substrate 1. Both the radiation electrodes 2 and 3 have a bent shape and have open ends 2*a* and 3*a* on a first edge of the substrate 1. The electrodes 2 and 3 are connected at their other ends via the edge opposedly facing the first edge and its adjacent lateral surface to a ground electrode indicated by the hatched portion shown in FIG. 1 formed on the reverse surface of the substrate 1.

A feeding electrode 4 is formed between the open ends 2*a* and 3*a* of the radiation electrodes 2 and 3 with respective gaps g1 and g2. This electrode 4 is guided to the reverse surface of the substrate 1 via the first edge of the substrate 1 and its adjacent surface and is electrically insulated from the ground electrode by virtue of the material of the substrate 1.

The resonant frequency of the radiation electrodes 2 and 3 can be determined by adjusting their lengths and widths, and the electrodes 2 and 3 can be excited by the feeding electrode 4 through capacitances generated in the gaps g1 and g2. In this case, a current flows in the electrodes 2 and 3 in the same direction.

An electrical equivalent circuit of this embodiment can be represented, as illustrated in FIG. 2. In this illustration, Cg1 and Cg2 indicate the capacitances generated in the gaps g1 and g2; L2 and L3 designate the radiation inductances of the radiation electrodes 2 and 3; and R2 and R3 depict the radiation resistances of the electrodes 2 and 3. In this manner, the lengths and widths of the radiation electrodes 2 and 3 can be varied to differentiate the radiation antenna constant and also to produce different frequencies, such as f2 and f3. The frequency characteristics of this embodiment are shown in FIG. 3.

According to this embodiment, two frequencies f2 and f3 can be obtained, as illustrated in FIG. 3, merely with the use of a single surface mounting antenna, and thus, this type of antenna is applicable to a communication system having different transmitting and receiving passbands. If these frequencies f2 and f3 in the diagram of FIG. 3 are brought closer to each other, an antenna exhibiting wider bandpass characteristics can be implemented.

An explanation will now be given of a second embodiment of the present invention while referring to FIG. 4. A surface mounting antenna generally indicated by 20 of this embodiment differs from the antenna 10 of the previous embodiment shown in FIG. 1 in that a radiation electrode 21 in a straight form is substituted for the bent electrode 2 so that the electrode length can be shortened, thereby increasing the resonant frequency f21. The other constructions of the antenna 20 are similar to those of the first embodiment, and thus, an explanation thereof will be omitted by designating the same elements by like reference numerals. The frequency characteristics of the second embodiment are shown in FIG. 5 in which f3 and f21 represent the resonant frequencies of the radiation electrodes 3 and 21, respectively.

A third embodiment of the present invention will now be explained with reference to FIG. 6. In a surface mounting antenna generally represented by 30, a straight radiation electrode 31 is disposed between the bent shape radiation electrodes 2 and 3 shown in FIG. 1 so as to attain three frequencies f2, f3 and f31. The radiation electrodes are excited by the feeding electrode 4. The radiation electrode 31 is excited by the feeding electrode 4 through a capacitance generated in a gap g3 formed between the opened end 31*a* of the electrode 31 and the feeding electrode 4. The other constructions of this embodiment are similar to those of the first embodiment, and an explanation thereof will thus be omitted by designating the same elements by like reference numerals. The frequency characteristics of the third embodiment are illustrated in FIG. 7 in which f2, f3 and f31 depict the resonant frequencies of the radiation electrodes 2, 3 and 31, respectively.

A description will now be given of a fourth embodiment while referring to FIG. 8. A surface mounting antenna of this embodiment generally indicated by 40 is different from the antenna 20 shown in FIG. 4 in that a straight radiation electrode 41 is used instead of the bent radiation electrode 3 so that the electrode length can be shortened, thereby increasing the resonant frequency. In particular, in this embodiment, the distance d between the radiation electrodes 21 and 41 is set equal to three times or larger than the electrode width w of the radiation electrode 21 (41), thereby reducing loss caused by reflected waves. The other constructions of this embodiment are similar to those of the second embodiment shown in FIG. 4, and an explanation thereof will thus be omitted by indicating the same elements by like reference numerals.

A fifth embodiment of the present invention will now be described with reference to FIG. 9. A surface mounting antenna generally designated by 50 has a rectangular substrate 51 formed of a dielectric material, such as ceramic or resin, or a magnetic material, such as ferrite. Formed on the obverse surface of the substrate 51 are a bent shape $\lambda/4$ radiation electrode 52 and a straight $\lambda/4$ radiation electrode 53 with their open ends 52*a* and 53*a* facing each other across a gap g1. The radiation electrodes 52 and 53 are connected at their other ends via the corresponding lateral surfaces to a ground electrode indicated by the hatched portion shown in FIG. 9 disposed on the reverse surface of the substrate 51.

A feeding electrode 54 is formed adjacent to the opened ends 52*a* and 53*a* of the radiation electrodes 52 and 53 with gaps g2 and g3, respectively. This feeding electrode 54 is guided to the reverse surface of the substrate 51 via one side of the substrate 51 and its adjacent lateral surface, and is electrically insulated from the ground electrode on the reverse surface by virtue of the material of the substrate 51.

The resonant frequencies of the radiation electrodes 52 and 53 are determined by regulating the lengths and widths of the electrodes 52 and 53, and the electrodes 52 and 53 can be excited by the feeding electrode 54 through capacitances generated in the gaps g2 and g3.

In this embodiment, the feeding electrode 54 and the open ends 52*a* and 53*a* of the radiation electrodes 52 and 53 are formed at the center of the substrate 51 so that opposite-directional currents can flow in the radiation electrodes 52 and 53, thereby inhibiting electromagnetic coupling between the electrodes 52 and 53.

An explanation will be further given of a communication apparatus provided with one of the aforedescribed surface mounting antennas 10 through 50 while referring to FIG. 10. One of the surface mounting antennas 10 through 50 is mounted on a communication apparatus generally represented by 61 by soldering the feeding electrode and the ground electrode of the antenna to a circuit board (or its sub board) of the apparatus 61.

As will be clearly understood from the foregoing description, the present invention offers the following advantages.

At least two radiation electrodes having different frequencies are disposed on a single substrate. By the use merely of this single substrate, it is possible to implement a surface mounting antenna through which signals having a plurality of frequencies can be transmitted and received. Also, if the plurality of frequencies are brought close to each other, a wider-bandwidth antenna can be constructed.

Moreover, the distance between the plurality of radiation electrodes is set equal to three times or larger than the electrode width. This can suppress electromagnetic coupling occurring between the radiation electrodes, thereby reducing loss. Further, opposite-directional currents are caused to flow in the radiation electrodes, thereby inhibiting electromagnetic coupling between the electrodes.

Additionally, a communication apparatus having the above type of surface mounting antenna has advantages similar to those achieved by the antenna. Hence, a wider-band, higher-gain and downsized communication apparatus can be achieved.

Although preferred embodiments of the present invention have been described above, it should be understood that the present invention is not limited thereto and that other modifications will be apparent to those skilled in the art without departing from the spirit of the invention.

What is claimed is:

1. A surface mounting antenna comprising:

a substrate formed of at least one of a dielectric material and a magnetic material;

at least two radiation electrodes for producing different resonant frequencies disposed on a first main surface of said substrate;

a ground electrode disposed on a second main surface of said substrate; and a feeding electrode disposed on said substrate;

said radiation electrodes each being open at first ends thereof and connected at second ends to said ground electrode, said feeding electrode and the open ends of said radiation electrodes being electromagnetically coupled to each other through capacitances.

2. The surface mounting antenna of claim 1, wherein the feeding electrode is disposed on the first main surface of the sustrate.

3. The surface mounting antenna of claim 2, wherein the open ends of said radiation electrodes and said feeding electrode are formed at one edge of said first main surface of said substrate so that a current is caused to flow in each said radiation electrodes in the same direction.

4. The surface mounting antenna of claim 2, wherein the open ends of said radiation electrodes and said feeding electrode are formed substantially at the center of said first main surface of said substrate so that opposite-directional currents are caused to flow in said radiation electrodes.

5. The surface mounting antenna of claim 2, wherein the radiation electrodes have a distance therebetween, the distance between said radiation electrodes being equal to at least three times the width of said radiation electrodes.

6. The surface mounting antenna of claim 3, wherein the radiation electrodes have a distance therebetween, the distance between said radiation electrodes being equal to at least three times the width of said radiation electrodes.

7. The surface mounting antenna of claim 4, wherein the radiation electrodes have a distance therebetween, the distance between said radiation electrodes being equal to at least three times the width of said radiation electrodes.

8. The surface mounting antenna of claim 2, wherein at least one of said radiation electrodes has a bent shape.

9. The surface mounting antenna of claim 2, wherein at least one of said radiation electrodes has a straight line shape.

10. The surface mounting antenna of claim 2, wherein the radiation electrodes each have a length approximately one quarter wavelength a predetermined frequency.

11. The surface mounting antenna of claim 2, further comprising a third radiation electrode disposed between the two radiation electrodes.

12. The surface mounting antenna of claim 2, wherein the capacitances comprise respective gaps between the feeding electrode and the open ends of the radiation electrodes.

13. The surface mounting antenna of claim 11, wherein the third radiation electrode is coupled to the feeding electrode via a capacitance.

14. The surface mounting antenna of claim 2, wherein the surface mounting antenna has a radiation characteristic comprising a resonant frequency corresponding to each radiation electrode.

15. The surface mounting antenna of claim 14, wherein the resonant frequencies are arranged close to each other so that the surface mounting antenna has a wider bandwidth.

16. The surface mounting antenna of claim 4, wherein the opposite directional currents inhibit electromagnetic coupling between the radiation electrodes.

17. The surface mounting antenna of claim 2, wherein the substrate is ceramic resin.

18. The surface mounting antenna of claim 2, wherein the substrate is ferrite.

19. A communication apparatus having a surface mounting antenna comprising:

a substrate formed of at least one of a dielectric material and a magnetic material;

at least two radiation electrodes for producing different resonant frequencies disposed on a first main surface of said substrate;

a feeding electrode disposed on said first main surface of said substrate; and a ground electrode disposed on a second main surface of said substrate;

said radiation electrodes each being open at first ends thereof and being connected at second ends to said ground electrode, said feeding electrode and the open ends of said radiation electrodes being electromagnetically coupled to each other through capacitances.

20. The communication apparatus of claim 19, wherein the open ends of said radiation electrodes and said feeding electrode are formed at one edge of said first main surface of said substrate so that a current is caused to flow in each of said radiation electrodes in the same direction.

21. The communication apparatus of claim 19, wherein the open ends of said radiation electrodes and said feeding electrode are formed substantially at the center of said first main surface of said substrate so that opposite-directional currents are caused to flow in said radiation electrodes.

22. The communication apparatus of claim 19, wherein the radiation electrodes have a distance therebetween, the distance between said radiation electrodes being equal to at least three times the width of said radiation electrodes.

23. The communication apparatus of claim 20, wherein the radiation electrodes have a distance therebetween, the distance between said radiation electrodes being equal to at least three times the width of said radiation electrodes.

24. The communication apparatus of claim 21, wherein the radiation electrodes have a distance therebetween, the distance between said radiation electrodes being equal to at least three times the width of said radiation electrodes.

25. The communication apparatus of claim 19, wherein at least one of said radiation electrodes has a bent shape.

26. The surface mounting antenna of claim 19, wherein at least one of said radiation electrodes has a straight line shape.

27. The communication apparatus of claim 19, wherein the radiation electrodes each have a length approximately one quarter wavelength a predetermined frequency.

28. The communication apparatus of claim 19, further comprising a third radiation electrode disposed between the two radiation electrodes.

29. The communication apparatus of claim 19, wherein the capacitances comprise respective gaps between the feeding electrode and the open ends of the radiation electrodes.

30. The communication apparatus of claim 28, wherein the third radiation electrode is coupled to the feeding electrode via a capacitance.

31. The communication apparatus of claim 19, wherein the antenna has a radiation characteristic comprising a resonant frequency corresponding to each radiation electrode.

32. The communication apparatus of claim 31, wherein the resonant frequencies are arranged close to each other so that the antenna has a wider bandwidth.

33. The communication apparatus of claim 21, wherein the opposite directional currents inhibit electromagnetic coupling between the radiation electrodes.

34. The communication apparatus of claim 19, wherein the substrate is ceramic resin.

35. The communication apparatus of claim 19, wherein the substrate is ferrite.

* * * * *